United States Patent [19]

Kamin

[11] 4,356,935

[45] Nov. 2, 1982

[54] METHOD AND APPARATUS FOR STORING AND DISPENSING FLUID FOODSTUFF

[75] Inventor: Robert Y. Kamin, Narberth, Pa.

[73] Assignee: Kardon Industries, Inc., Philadelphia, Pa.

[21] Appl. No.: 31,041

[22] Filed: Apr. 18, 1979

[51] Int. Cl.[3] ..... G01F 11/00

[52] U.S. Cl. ..... 222/1; 222/153; 222/327; 222/490; 206/384

[58] Field of Search ..... 222/490, 494, 326, 327, 222/386.5, 387, 386, 153; 220/93, 319; 206/384

[56] References Cited

U.S. PATENT DOCUMENTS

| | | | |
|---|---|---|---|
| 1,989,715 | 2/1935 | Statham | 222/490 |
| 2,090,111 | 8/1937 | Creveling | 222/386 |
| 2,555,380 | 6/1951 | Stuart et al. | 229/93 X |
| 2,556,571 | 6/1951 | Bobbs | 222/494 X |
| 2,649,999 | 8/1953 | Burch | 222/327 X |
| 2,855,130 | 10/1958 | Hosler | 222/327 |
| 2,941,697 | 6/1960 | Biedenstein | 222/327 X |
| 2,941,699 | 6/1960 | Schmidt et al. | 222/327 |
| 3,071,294 | 1/1963 | Galbierr | 222/327 |
| 3,241,726 | 3/1966 | Chester | 222/490 X |
| 3,669,323 | 6/1972 | Harker et al. | 222/490 |
| 3,884,396 | 5/1975 | Gordon et al. | 222/490 X |

*Primary Examiner*—Robert J. Spar
*Assistant Examiner*—Frederick R. Handren
*Attorney, Agent, or Firm*—Benasutti Associates, Ltd.

[57] ABSTRACT

A container for storing and dispensing fluid foodstuffs, such as sauces and the like. The container includes a spiral wound tube having a circular retaining disc mounted at one end. The retaining disc has an aperture therein, through which is mounted a pressure responsive dispensing nozzle having a flexible disc with cross-cross slits therein that open under pressure to allow the discharge of the stored foodstuff. The other end of the tube contains a piston disposed within the tube. The piston is initially retained adjacent the end of the tube by a retaining ring. The piston contains a dimpled portion configured for mating engagement with the dispensing nozzle. A sheet of metallic material is attached to the dispensing nozzle, providing a temporary seal.

28 Claims, 4 Drawing Figures

METHOD AND APPARATUS FOR STORING AND DISPENSING FLUID FOODSTUFF

BACKGROUND OF THE INVENTION

The present invention generally relates to containers for foodstuffs and, more particularly, to containers used for storing and subsequently dispensing fluid foodstuffs such as sauces and the like.

In the field of high volume, fast food service, it is frequently desired that the food itself be supplemented by sauces and other condiments such as catsup, mustard, mayonnaise, and other dressings. For example, in practically all of the fast food retail outlets specializing in hamburgers, fish sandwiches and the like, it is most desirable to provide these condiments to augment the food flavor. In the past, this has been accomplished in several ways. The simplest way is to sell the hamburger or similar food without any sauce or dressing and provide the condiments to the purchaser in individually wrapped single service packages. Although a simple solution, this approach can be expensive and wasteful in that more servings will possibly be taken than will be used with the excess being thrown away.

Another solution is to provide the consumer with the condiments in multiple use packages, such as squeeze bottles and the like, and permit the consumer to apply his own sauce after purchasing the food. This again can be expensive and wasteful, since many times the consumer will apply much more sauce than is actually necessary to adequately flavor or season the food. In addition, the retail establishment must provide employees to constantly refill these multi-use containers.

SUMMARY OF THE INVENTION

The present invention provides an apparatus and method for storing and dispensing fluid foodstuffs, such as sauces and the like. This is accomplished by numerous features incorporated in applicant's invention.

One such feature is a novel container for storing the fluid foodstuffs, which container can be ultimately used to dispense the stored foodstuffs in measured quantities at a high rate. The container comprises a tubular enclosure having a first closure means mounted in sealing engagement with one end thereof. This first closure means includes a retaining member having a pressure responsive dispensing nozzle disposed therein. During storage, a removable, temporary seal is attached to the pressure responsive dispensing nozzle. A second closure means is mounted in sealing engagement with the other end of the tubular enclosure. The second closure means includes a piston which is slidably disposed within the tubular enclosure and a retaining ring for initially retaining the piston within the tubular enclosure adjacent the end.

The novel method of the present invention includes the steps of: first, providing a tubular enclosure having a first closure means mounted in sealing engagement with one end. It is preferable that a temporary seal be attached to the nozzle at this time. The container is then filled with fluid foodstuff such as catsup, mustard or other sauces or dressings. A second closure means is then mounted in sealing engagement with the other end of the tubular enclosure. The completely enclosed container is now ready for either immediate use, or for storage of the foodstuff during transportation and/or shelf storage while awaiting use.

When ready for use, the novel container with the sauce therein is placed in a using apparatus. The apparatus will restrain the enclosure while exerting a force to depress the piston within the tubular enclosure. Prior to operation, the temporary sealing member is removed from the pressure responsive dispensing nozzle. The nozzle is then placed over the sandwich or other food on which the contents of the container is to be placed. The apparatus then depresses the piston causing the contents to be ejected from the pressure responsive dispensing nozzle, through a novel diffuser member, onto the receiving food. The amount of contents to be dispensed is regulated by the distance the piston is depressed. The food with the sauce thereon is then removed and replaced by the next item of food to receive sauce. This cycle is continued until the contents of the container are exhausted.

Another novel feature of the present invention, a dimpled portion of the piston which mates with the dispensing nozzle, insures that practically all of the contents of the container is dispensed thereby minimizing waste.

Upon the exhaustion of the contents, the container is removed from the apparatus, discarded, and replaced with a filled container.

Accordingly, a primary object of the present invention is the provision of a novel container for storing and dispensing fluid foodstuffs.

Another object of the present invention is the provision of a container, the use of which enables the dispensing of the fluid foodstuffs in measured amounts at a high rate.

A further object of the present invention is the provision of a container for minimizing waste of fluid foodstuffs, such as sauces and the like.

An additional object of the present invention is the provision of a method for storing and dispensing fluid foodstuffs whereby labor, waste and expense are minimized.

These and other objects of the present invention will become apparent from the following more detailed description.

DETAILED DESCRIPTION OF THE DRAWINGS

Figure 1:
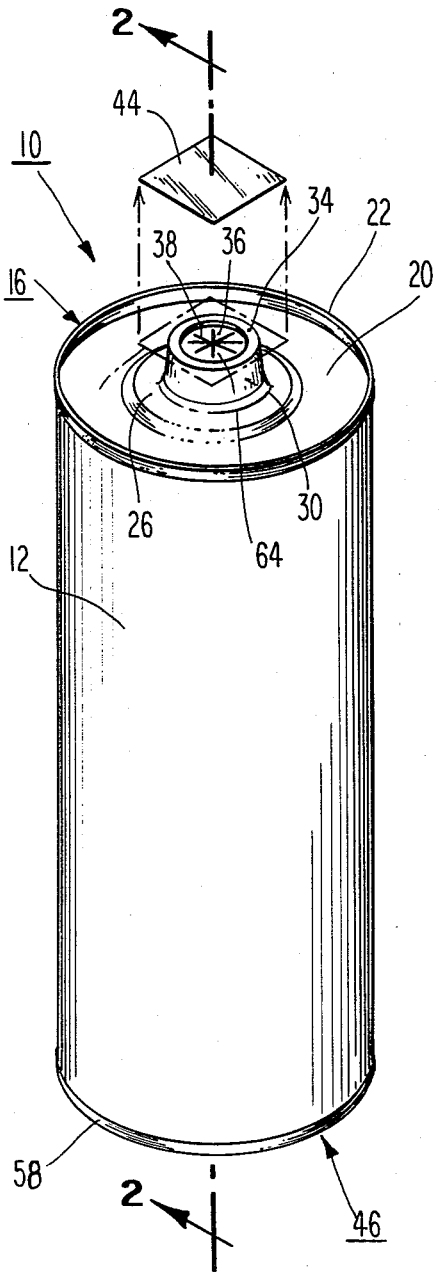
FIG. 1 is a perspective view of the preferred embodiment of the container of the present invention showing placement of a temporary sealing member.

Although specific terms of the invention have been selected for illustration in the drawings and the following description is drawn in specific terms for the purpose of describing these forms of the invention, this description is not intended to limit the scope of the invention which is defined in the appended claims.

Figure 2:
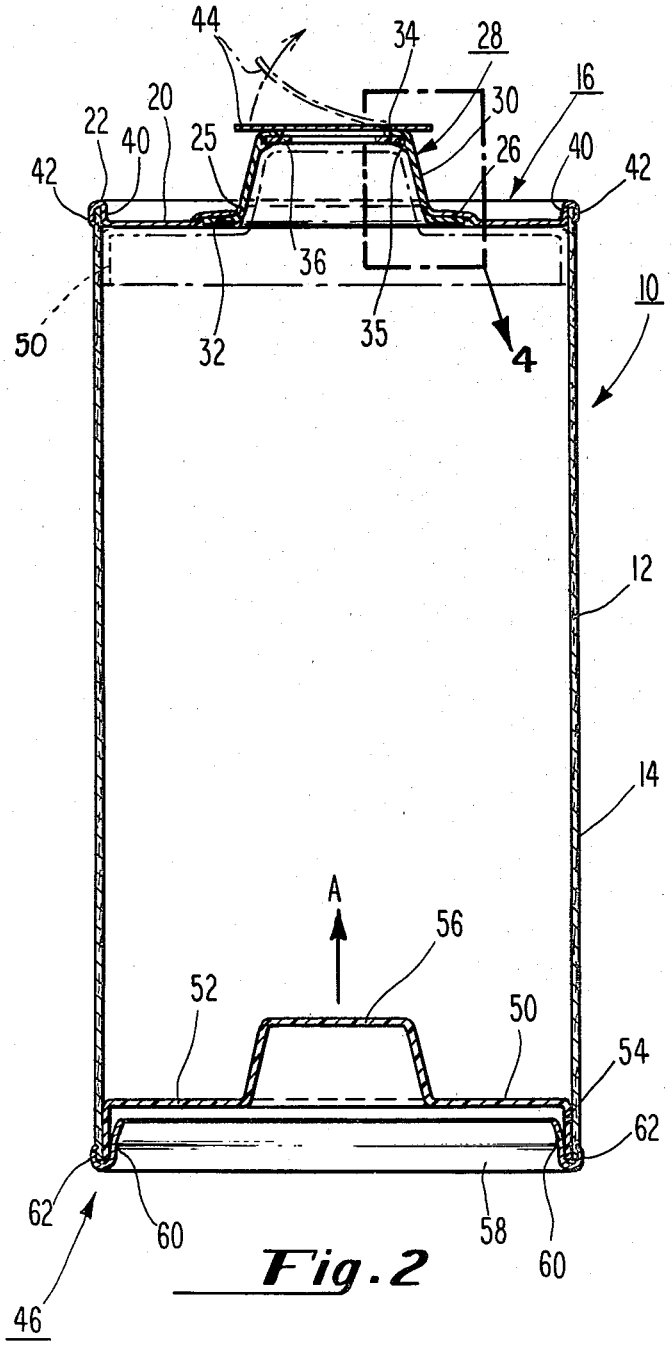
FIG. 2 is a cross-section taken along lines 2—2 of FIG. 1.
Figure 3:
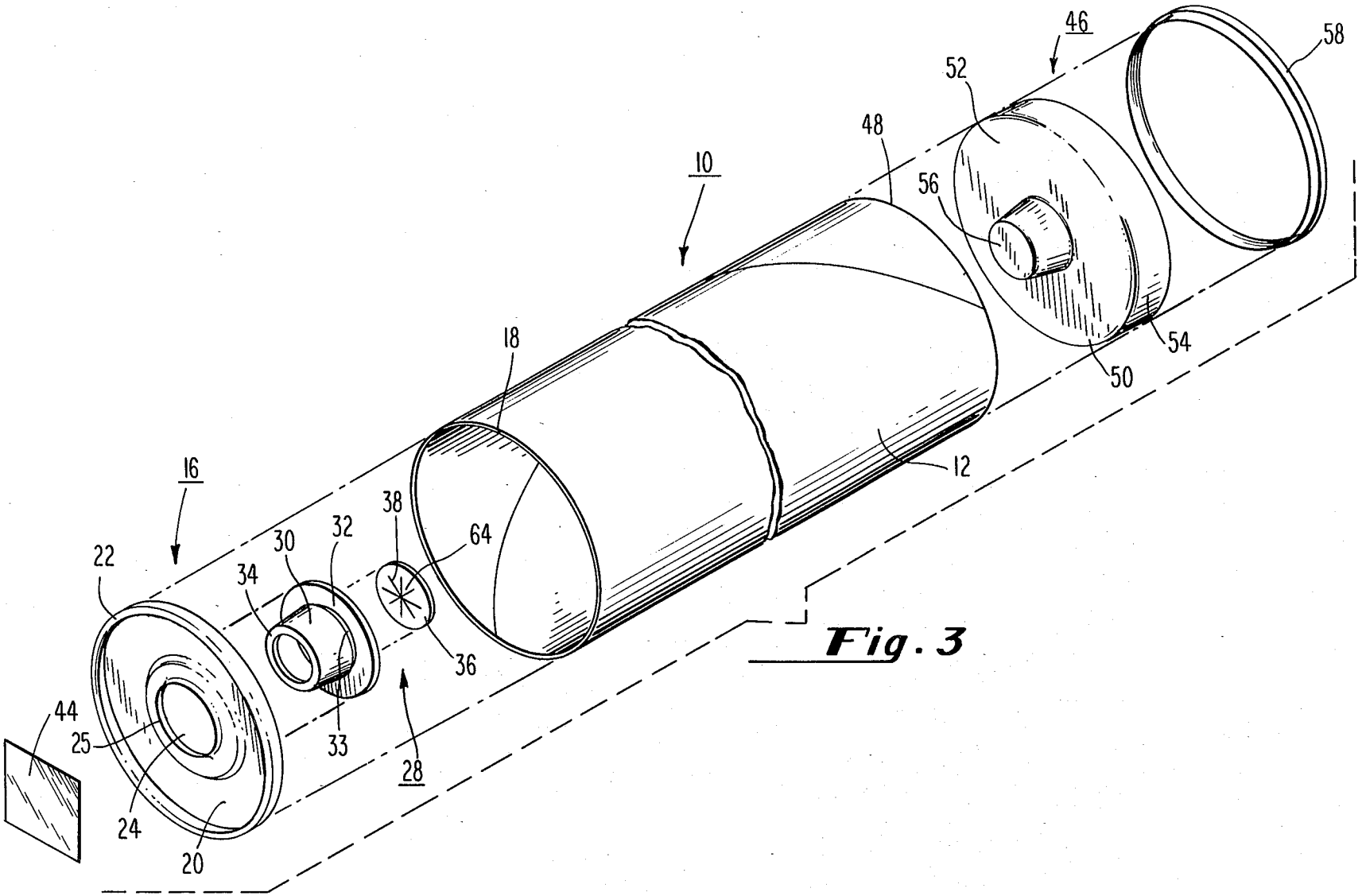
FIG. 3 is an exploded perspective view of the container of the present invention showing the component parts of the preferred embodiment.

Referring to FIGS. 1, 2 and 3, there is shown the preferred embodiment of the container of the present invention generally designated 10. The container 10 comprises a tubular enclosure 12. The enclosure 12 is, in the preferred embodiment, a spiral wound cylinder comprising a strip of a planar material, for example cardboard, which is spiral wound to form a circular wall 14 (see FIG. 2). In the preferred embodiment, the tubular enclosure has a smooth coating on the interior cylindrical surface. This coating is preferably a spiral wound strip of planar metallic material, such as aluminum foil, which is overlaid on the interior surface of the cardboard material. The preferred embodiment also includes a veneer layer on the exterior surface of the cardboard tubular enclosure. This veneer layer is preferably a spiral wound strip of planar material, such as 55 lb. Kraft paper, which is overlaid on the exterior surface of the cardboard enclosure.

Figure 4:
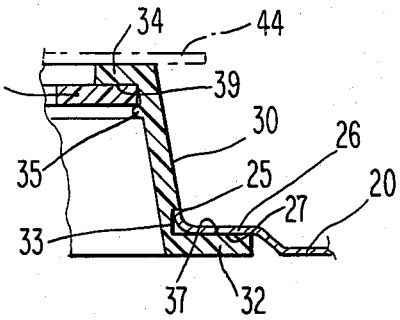
FIG. 4 is an enlarged, exploded view of that portion of FIG. 2 included within enclosed line 4.

A first closure means, generally designated 16, is mounted in sealing engagement with a first end 18 (see FIG. 3) of the tubular enclosure 12. The first closure means 16 includes a circular disc 20 having a flange 22 formed around the periphery thereof; and a substantially circular aperture 24 in approximately the center of the disc 20 (see FIG. 3), the perimeter of the aperture 24 being defined by inner edge 25 of the disc 20. As shown more clearly in the enlarged view depicted in FIG. 4, the inner edge 25 is preferably slightly upturned for reasons which will be further explained hereinafter. The disc 20 also includes an embossed region 26, surrounding the aperture 24, having a lower surface 27.

The first closure means 16 also includes a pressure responsive dispensing nozzle, generally designated 28. The nozzle 28 includes a tubular housing member 30, preferably having a slightly conical shape (walls inclined 4° from vertical in the preferred embodiment), and having an outwardly depending flange 32 at one end (see FIGS. 2, 3 and 4) and an inwardly depending flange 34, having an inner surface 39, at the other end. The housing member 30 is preferably made of a plastic material such as polypropylene. The housing member 30 has an undercut portion 33 (see FIGS. 3 and 4) in the outer surface thereof adjacent an upper surface 37 of the outwardly depending flange 32. The housing member 30 also includes a diffuser retaining portion 35 which, in the preferred embodiment, comprises an inwardly depending ridge in proximity to, but spaced from, the inner surface 39 of the inwardly depending flange 34.

The nozzle 28 is attached to the disc 20 by inserting the housing member 30 through the aperture 24 from the underside of the disc 20, in the direction generally indicated by arrow A in FIG. 2, until the inner edge 25 of the disc 20 engages the undercut portion 33 of the housing member 30. The spacial relationship of the undercut portion 33 to the upper surface 37 of the flange 32 is such that the upper surface 37 seats tightly against the lower surface 27 of the embossed region 26 when the inner edge 25 of the disc 20 engages the undercut portion 33. As previously stated, the inner edge 25 is slightly upturned in the preferred embodiment. The reasons for this are that this configuration facilitates the insertion of the housing member 30 through the aperture 25, especially as the larger diameter conical walls engage inner edge 25. In addition, once seated, the upturned inner edge engages the upper edge of the undercut portion 33 (see FIG. 4) thereby preventing the withdrawal of the housing member 30 from the aperture 24 in a direction opposite that indicated by arrow A in FIG. 2.

A diffuser member, comprising a flexible disc 36, is retained within the housing member 30. The disc 36 is held adjacent the inner surface 39 of the inwardly depending flange 34 by the retaining portion 35 of the housing member 30. The flexible disc 36 is preferably made of a plastic material, such as polypropylene. In addition, the disc 36 is of a size such that its edge, while slightly overlapping the retaining portion 35, does not extend beyond the inner perimeter of the housing member at the space defined between the retaining portion 35 and the inner surface 39 of the inwardly depending flange 34; and its thickness is no greater than, and preferably slightly less than, the height of said space. Consequently, the disc 36 is attached to the housing member 30 by placing the disc 36 within the housing member 30 and forcing it through the retaining portion 35, whereupon a snap fit of the disc 36 between the retaining portion 35 and the inner surface 39 of the inwardly depending flange 34 is effected. Note that although the preferred embodiment of the retaining portion 35 is a ridge which extends around the inner surface of the housing member 30, the retaining portion 35 may also comprise at least two tabs which extend inwardly, and this alternate configuration is considered to be within the scope and contemplation of the present invention.

The flexible disc 36 has at least one slit therein and, in the preferred embodiment, has four intersecting slits 38 (see FIGS. 1 and 3). Each slit intersects the other three at the approximate midpoint and each has a substantially equal angular displacement from adjacent slits as can be seen in FIGS. 1 and 3.

The first closure means 16 is mounted in sealing engagewith the first end 18 of the tubular enclosure 12. As shown in FIG. 2, the flange 22 of the disc 20 is adapted for receiving the end of the circular wall 14. To accomplish this, the flange 22 has a U-shaped cross-section as shown in FIG. 2, having inner and outer portions 40 and 42, respectively. After receiving the end of the circular wall, the outer portion 42 of the flange 22 is then crimped inwardly against the wall material thereby forming an effective mechanical seal.

While being filled and used as a storage container, a temporary sealing member 44 is attached to the exterior surface of the inwardly depending flange 34 of the tubular housing member 30. In the preferred embodiment, the sealing member 44 is a substantially rectangular sheet of metallic material, for example, aluminum foil, which is coated with a thin layer of plastic material, for example polypropylene, and which is attached to the flange 34 by heat sealing. Just prior to use, one of the four extending corners can be grasped and the sealing member 44 peeled away as shown in phantom in FIG. 2.

A second closure means, generally referred to as 46, is mounted in sealing engagement with a second end 48 of the tubular enclosure 12 opposite the first end 18 (see FIG. 3). The second closure means 46 includes a piston 50 which is mounted within the tubular enclosure 12. The piston 50 comprises a circular disc 52 with a flange 54 formed around its periphery. The piston 50 also includes a dimpled region 56. The dimpled region 56 is dimensioned such that it will mate with the interior of the tubular housing 30 when the piston has moved the entire length of the tube from its initial position adjacent the second end 48 (see FIG. 2) to its final position adjacent the first end 18 (shown in phantom in FIG. 2). As shown in FIG. 2, when the piston is mounted in its initial position within the tubular enclosure 12, the flange 54 extends toward the second end 48 with the terminal end of the flange 54 being substantially coplanar with the second end 48. Also, the dimpled portion 56 extends toward the first end 18.

The piston 50 is initially retained adjacent the second end 48 by means of a retaining ring 58. As shown in FIG. 2, the retaining ring 58 has a substantially U-shaped cross-section formed by an inner flange 60 and an outer flange 62. The flange 54 of the piston 50 as well as the wall 14 of the tubular enclosure 12 are initially situated between the inner and outer flanges, 60 and 62, of the retaining ring 58. The outer flange 62 is then crimped against the outer surface of the wall 14 of the tubular enclosure 12, forming a mechanical seal between the retaining ring 58, wall 14 and flange 54. An initial force exerted in the direction indicated by the arrow A will cause the flange 54 of the piston 50 to withdraw from the recess created by the inner flange 60 of the retaining ring 58 and the wall 14 of the tubular enclosure 12 thereby freeing the piston to travel through the tubular enclosure 12 in the direction A.

Using the container of the present invention, the following is a description of how the fluid foodstuffs are stored and dispensed. Initially, the container 10 is assembled by mounting the first closure means 16 in sealing engagement with the first end 18 of the tubular enclosure 12, thereby forming a container which is closed at one end (first end 18) and which is ready to receive its contents through the other, still open end (second end 48). It is preferred, at this time, that the temporary sealing member 44 be attached to the external surface of the inwardly depending flange 34 of the pressure responsive dispensing nozzle 28. At this point, the second end 48 of the tubular enclosure 12 is open in order that the container 10 may be filled with the desired fluid foodstuffs, such as catsup, mustard, mayonnaise, or other sauces, condiments or dressings.

After the container 10 has been filled with the desired foodstuff, the second closure means 46 is mounted in sealing engagement with the second end 48 of the tubular enclosure 12 thereby closing the container with the foodstuff therein. The container is now filled and sealed and may be used for transporting and storing its contents.

When ready for use, the container 10 is placed in the using apparatus (not shown) and the temporary seal 44 is removed. It is preferred that the container is used in a vertical position, with the pressure dispensing nozzle 28 in the bottommost position.

In use, the using apparatus (not shown) restrains the tubular enclosure 12 while exerting a force on the piston 50 in the direction indicated by arrow A in FIG. 2. This causes the contents to be diffusively exuded through the slits 38 in the flexible disc 36 since the flexible, triangular shaped flaps 64 formed by the slits 38 will move outwardly thereby forming an aperture. When the force is removed from the piston 50, the flexible flaps 64 will return to their original position thereby closing off the aperture.

The amount of sauce which is dispensed is directly related to the distance which the piston 50 moves through the tubular enclosure 12. As previously stated, the contents of the container 10 will be completely dispensed when the piston 50 has moved from its initial position adjacent the second end 48 to its final position adjacent the first end 18. As previously stated, the piston is configured such that when it is in its final position as shown in phantom in FIG. 2, the interior surfaces of the piston substantially engage the interior surfaces of the first closure means 16 thereby insuring that substantially all of the contents of the container 10 have been dispensed.

It will be understood that various changes in the details, materials and arrangements of parts which have been herein described and illustrated in order to explain the nature of this invention may be made by those skilled in the art within the principle and scope of the invention as expressed in the following claims.

What is claimed is:

1. A disposable container for storing and dispensing fluid foodstuffs, such as sauces and the like, said container comprising:

(a) an open ended spiral wound tubular enclosure having a substantially uninterrupted interior surface and an exterior surface defining said tubular enclosure;

(b) first closure means mounted at one end of said tubular enclosure, said first closure means including a retaining member having a first circumference dimensioned for sealing engagement with said tubular enclosure and a second circumference defining an aperture therein, and a normally closed pressure responsive dispensing nozzle disposed through said aperture; and (c) second closure means mounted at the opposite end of said tubular enclosure from said first closure means, said second closure means including piston means having a rearwardly disposed flange dimensioned to slideably engage said interior surface of said tubular enclosure and a retaining ring, generally U-shaped in cross-section and having a first portion dimensioned for permanent crimped engagement with said exterior surface of said tubular enclosure and a second portion dimensioned to engage said flange so that said flange and said opposite end of said tubular enclosure are situated between said first and second portion of said retaining ring and so that said flange is maintained in a releasable mechanical engagement between said second portion and said tubular enclosure.

2. The invention of claim 1 wherein said tubular enclosure comprises a strip of planar material, spiral wound to form a substantially circular wall.

3. The invention of claim 2 wherein said planar material comprises cardboard.

4. The invention of claim 3 wherein said tubular enclosure has a coating on the interior surface thereof.

5. The invention of claim 4 wherein said coating comprises a spiral wound strip of planar material overlaid on said interior surface.

6. The invention of claim 5 wherein said planar coating material comprises a thin sheet of metallic material.

7. The invention of claim 2 wherein said retaining member comprises a substantially circular disc having a lower surface, said disc having an edge formed around the periphery thereof, said edge adapted for receiving and sealingly engaging said one end of said circular wall, and having said aperture therein adapted for receiving said normally closed pressure responsive dispensing nozzle therethough, said aperture having a circumference which is defined by an inner edge of said disc, said inner edge including means for locking said nozzle in said aperture.

8. The invention of claim 7 wherein said normally closed pressure responsive dispensing nozzle comprises a substantially tubular housing member having a diffuser member disposed therein, said tubular housing member adapted to sealingly engage said disc adjacent the inner edge of said aperture.

9. The invention of claim 8 wherein said housing member comprises:

(a) a substantially circular wall having an outer surface and an inner surface, and a first open end and a second open end, said outer surface including means for engaging the inner edge of said disc adjacent said first open end and said inner surface including means for retaining said diffuser member adjacent said second open end;

(b) an outwardly depending flange at said first end having an upper surface facing toward said second end; and (c) an inwardly depending flange at said second end having an inner surface facing said first end.

10. The invention of claim 9 wherein said means for locking said housing in said aperture of said disc comprises an undercut portion in said outer surface adjacent the upper surface of said outwardly depending flange.

11. The invention of claim 10 wherein the inner edge of said disc is upturned away from the lower surface of said disc, said upturned edge dimensioned to engage said undercut portion such that the upper surface of said outwardly depending flange is retained adjacent the lower surface of said disc.

12. The invention of claim 9 wherein said diffuser member comprises a substantially circular flexible disc having at least one slit therethrough.

13. The invention of claim 12 wherein said means for retaining said diffuser member comprises an inwardly depending ridge in proximity to, but spaced from, the inner surface of said inwardly depending flange for retaining said disc adjacent said inner surface.

14. The invention of claim 12 wherein said means for retaining said diffuser member comprises at least two inwardly depending, spaced apart tabs in proximity to but spaced from the inner surface of said inwardly depending flange for retaining said disc adjacent said inner surface.

15. The invention of claim 12 wherein said flexible disc member has at least two intersecting slits therein.

16. The invention of claim 15 wherein said flexible disc member has four slits therein, each slit intersecting the other three at the approximate midpoint thereof and having a substantially equal angular displacement from adjacent slits.

17. The invention of claim 9 wherein said first closure means additionally comprises a temporary sealing member removably attached in sealing engagement with the exterior surface of the inwardly depending flange of said tubular housing member.

18. The invention of claim 17 wherein said temporary sealing member comprises a thin sheet of plastic coated metallic material.

19. The invention of claim 18 wherein said temporary sealing member comprises a sheet polypropylene coated aluminum foil attached to said outer surface by heat sealing.

20. The invention of claim 1 wherein said piston means has a dimpled portion extending toward said first closure means, said dimpled portion configured for mating engagement with said normally closed pressure responsive dispensing nozzle.

21. A method of storing and dispensing fluid foodstuffs, such as sauces and the like, said method comprising the steps of:

(a) providing an open ended spiral wound tubular enclosure having first closure means mounted in sealing engagement with a first end thereof, said first closure means having a normally closed pressure responsive dispensing means associated therewith;

(b) filling said open ended spiral wound tubular enclosure with said fluid foodstuff through an opening in a second end thereof opposite said first end;

(c) sealing said opening in said second end with second closure means, said second closure means comprising piston means having a rearwardly disposed flange dimensioned to slideably engage said tubular enclosure and a retaining ring, generally U-shaped in cross-section and having a first portion for forming a permanent crimped engagement with said spiral wound tubular enclosure and a second portion for engaging said flange so that said flange and said second end of said tubular enclosure are situated between said first and second portion of said retaining ring and for maintaining said flange in a releasable mechanical engagement between said second portion and said second end of said tubular enclosure; and (d) dispensing said foodstuff through said normally closed pressure responsive dispensing means by moving said piston means from an initial position between said second portion of said flange and said second end of said tubular enclosure to a final position adjacent said first end of said spiral wound tubular enclosure.

22. The method of claim 21 including the additional steps of:

(a) removably attaching sealing means to said normally closed pressure responsive dispensing nozzle to temporarily seal said nozzle; and (b) removing said sealing means prior to dispensing said foodstuff.

23. The method of claim 21 including the additional steps of:

(a) providing a diffuser member; and (b) disposing said diffuser member within said pressure responsive nozzle whereby said foodstuff is dispensed through said diffuser member.

24. In a disposable container for storing and dispensing fluids, said container comprising an open ended tubular enclosure having an interior and an exterior surface and adapted for closure at one end by a dispensing means and at the other end by a closure means which comprises:

(a) piston means having a rearwardly disposed flange dimensioned to slideably engage said interior surface of said tubular enclosure, and (b) a retaining ring, generally U-shaped in cross-section and having a first portion dimensioned for permanent crimped engagement with said exterior surface of said tubular enclosure and a second portion dimensioned to engage said flange so that said flange and said other end of said tubular enclosure are situated between said first and second portion of said retaining ring and so that said flange is maintained in a releasable mechanical engagement between said second portion and said tubular enclosure to thereby permit said piston means to be moved within said tubular enclosure toward said dispensing means.

25. The invention of claim 24 wherein said first portion is adapted for receiving and sealingly engaging said other end of said tubular enclosure.

26. The invention of claim 24 wherein said piston means comprises a circular disc, and wherein the flange is formed around the periphery of said circular disc.

27. The invention of claim 26 wherein the circular disc of said piston means has a dimpled portion extending away from said flange, said dimpled portion being adapted for mating engagement with said dispensing means.

28. A method of storing and dispensing fluids from a container, said method comprising:

(a) providing a spiral wound tubular enclosure having a dispensing means at one end and another end which is open;

(b) providing fluid material within said tubular enclosure;

(c) enclosing the open end of said tubular enclosure with a piston means having a rearwardly disposed flange dimensioned to slideably engage said tubular enclosure;

(d) sealing said open end of said tubular enclosure with a retaining ring which is generally U-shaped in cross-section and having a first portion for forming a permanent crimped engagement with said tubular enclosure and a second portion for engaging said flange so that said flange and said open end of said tubular enclosure are situated between said first and second portion of said retaining ring and for maintaining said flange in a releasable mechanical engagement between said second portion and said open end of said tubular enclosure; and (e) moving said piston means within said tubular enclosure toward said dispensing means, thereby dispensing said fluid material.

* * * * *